US006485161B1

(12) United States Patent
Whitaker et al.

(10) Patent No.: US 6,485,161 B1
(45) Date of Patent: Nov. 26, 2002

(54) OUTDOOR DECORATIVE LIGHTING SYSTEM

(76) Inventors: Beatrice M. Whitaker, 211 Winslow Cir., Goldsboro, NC (US) 27530; Willie Bryant, 201 Winslow Cir., Goldsboro, NC (US) 27530

( * ) Notice: Subject to any disclaimer, the term of this patent is extended or adjusted under 35 U.S.C. 154(b) by 0 days.

(21) Appl. No.: 09/865,309

(22) Filed: May 25, 2001

(51) Int. Cl.[7] ..... F21V 21/005

(52) U.S. Cl. ..... 362/249; 362/431; 362/806; 362/396

(58) Field of Search ..... 362/219, 226, 362/249, 252, 382, 391, 396, 431, 806, 145

(56) References Cited

U.S. PATENT DOCUMENTS

| | | | | | |
|---|---|---|---|---|---|
| 2,920,184 | A | | 1/1960 | Kessler | |
| 3,500,036 | A | | 3/1970 | Szentveri | |
| 4,774,646 | A | | 9/1988 | L'heureux | |
| 5,067,061 | A | | 11/1991 | Prickett | |
| 5,410,458 | A | | 4/1995 | Bell | |
| 5,513,081 | A | * | 4/1996 | Byers | 362/806 |
| 5,683,172 | A | * | 11/1997 | Huag | 362/252 |
| 5,823,655 | A | * | 10/1998 | Brooks | 362/249 |
| D403,801 | S | | 1/1999 | Summers | |
| 6,305,822 | B1 | * | 10/2001 | Lin | 362/252 |

* cited by examiner

*Primary Examiner*—Y. My Quach-Lee

(57) ABSTRACT

An outdoor decorative lighting system for permanently installing outdoor decorative lighting for a structure. The outdoor decorative lighting system includes a light support assembly including a plurality of elongate light support members being fastenably connected end-to-end; and also includes a light-emitting assembly being mounted upon the elongate light support members and including a plurality of light socket members being spaced apart and being interconnected with wires and being mounted upon the elongate light support members, and also including a plurality of light-emitting members being removably disposed in the light socket members, and further including a power cord being connected to one of the light socket members.

9 Claims, 4 Drawing Sheets

OUTDOOR DECORATIVE LIGHTING SYSTEM

BACKGROUND OF THE INVENTION

1. Field of the Invention

The present invention relates to outdoor fighting systems and more particularly pertains to a new outdoor decorative lighting system for permanently installing outdoor decorative lighting for a structure.

2. Description of the Prior Art

The use of outdoor lighting systems is known in the prior art. More specifically, outdoor lighting systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,410,458; 3,500,036; 2,920,184; 4,774,646; U.S. Pat. No. Des. 5,067,061; and U.S. Patent No. Des. 403,801.

While these devices fulfill their respective, particular objectives and requirements, the aforementioned patents do not disclose a new outdoor decorative lighting system. The inventive device includes a light support assembly including a plurality of elongate light support members being fastenably connected end-to-end; and also includes a light-emitting assembly being mounted upon the elongate light support members and including a plurality of light socket members being spaced apart and being interconnected with wires and being mounted upon the elongate light support members, and also including a plurality of light-emitting members being removably disposed in the light socket members, and further including a power cord being connected to one of the light socket members.

In these respects, the outdoor decorative lighting system according to the present invention substantially departs from the conventional concepts and designs of the prior art, and in so doing provides an apparatus primarily developed for the purpose of permanently installing outdoor decorative lighting for a structure.

SUMMARY OF THE INVENTION

In view of the foregoing disadvantages inherent in the known types of outdoor lighting systems now present in the prior art, the present invention provides a new outdoor decorative lighting system construction wherein the same can be utilized for permanently installing outdoor decorative lighting for a structure.

The general purpose of the present invention, which will be described subsequently in greater detail, is to provide a new outdoor decorative lighting system which has many of the advantages of the outdoor lighting systems mentioned heretofore and many novel features that result in a new outdoor decorative lighting system which is not anticipated, rendered obvious, suggested, or even implied by any of the prior art outdoor lighting systems, either alone or in any combination thereof.

To attain this, the present invention generally comprises a light support assembly including a plurality of elongate light support members being fastenably connected end-to-end; and also includes a light-emitting assembly being mounted upon the elongate light support members and including a plurality of light socket members being spaced apart and being interconnected with wires and being mounted upon the elongate light support members, and also including a plurality of light-emitting members being removably disposed in the light socket members, and further including a power cord being connected to one of the light socket members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new outdoor decorative lighting system which has many of the advantages of the outdoor lighting systems mentioned heretofore and many novel features that result in a new outdoor decorative lighting system which is not anticipated, rendered obvious, suggested, or even implied by any of the prior art outdoor lighting systems, either alone or in any combination thereof.

It is another object of the present invention to provide a new outdoor decorative lighting system which may be easily and efficiently manufactured and marketed.

It is a further object of the present invention to provide a new outdoor decorative lighting system which is of a durable and reliable construction.

An even further object of the present invention is to provide a new outdoor decorative lighting system which is susceptible of a low cost of manufacture with regard to both materials and labor, and which accordingly is then susceptible of low prices of sale to the consuming public, thereby making such outdoor decorative lighting system economically available to the buying public.

Still yet another object of the present invention is to provide a new outdoor decorative lighting system which provides in the apparatuses and methods of the prior art some of the advantages thereof, while simultaneously overcoming some of the disadvantages normally associated therewith.

Still another object of the present invention is to provide a new outdoor decorative lighting system for permanently installing outdoor decorative lighting for a structure.

Yet another object of the present invention is to provide a new outdoor decorative lighting system which includes a light support assembly including a plurality of elongate light support members being fastenably connected end-to-end;

and also includes a light-emitting assembly being mounted upon the elongate light support members and including a plurality of light socket members being spaced apart and being interconnected with wires and being mounted upon the elongate light support members, and also including a plurality of light-emitting members being removably disposed in the light socket members, and further including a power cord being connected to one of the light socket members.

Still yet another object of the present invention is to provide a new outdoor decorative lighting system that is easy and convenient to install and use.

Even still another object of the present invention is to provide a new outdoor decorative lighting system that eliminates the user having to spend countless hours putting up lights about one's home.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
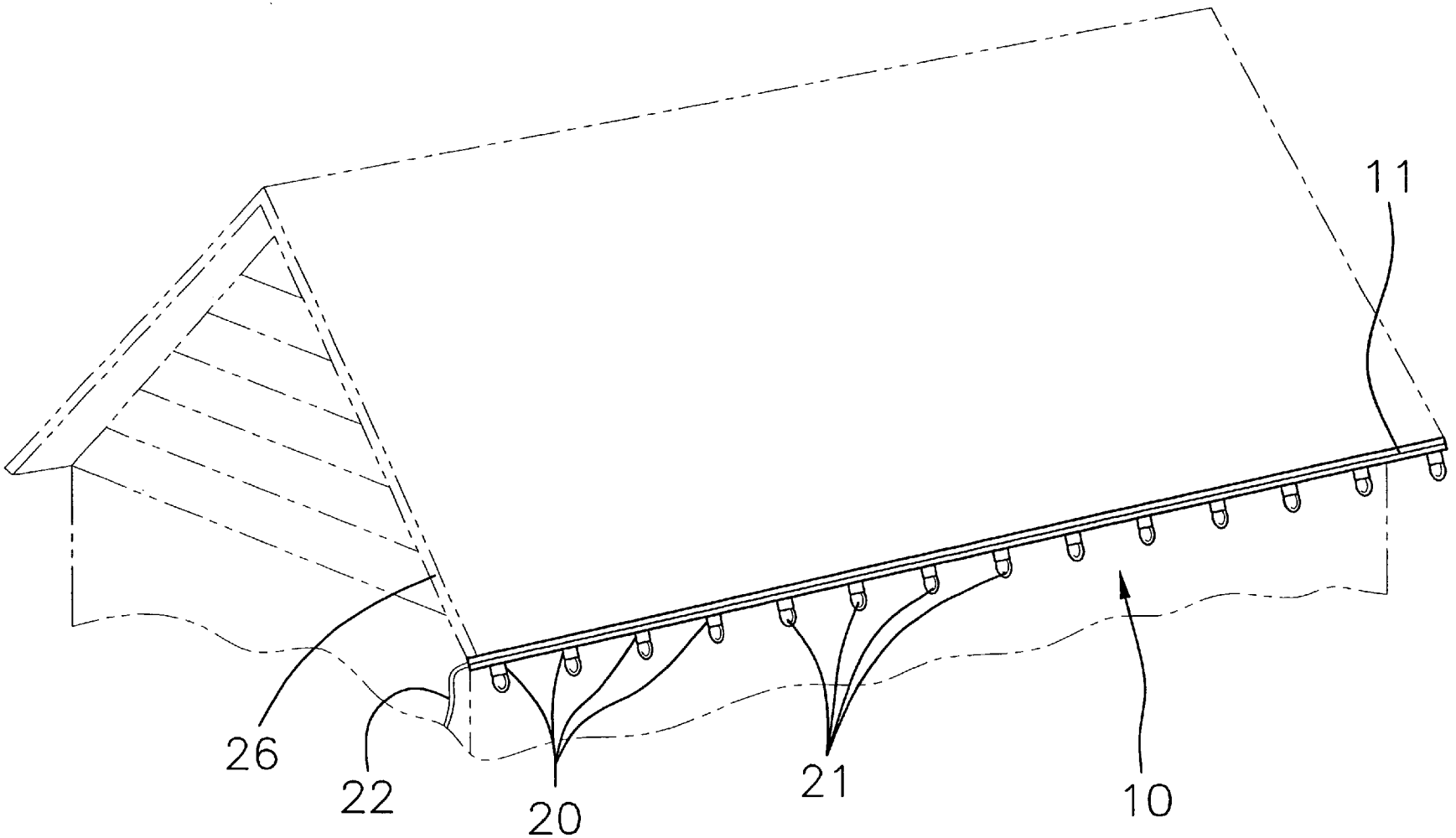
FIG. 1 is a perspective view of a new outdoor decorative lighting system according to the present invention and shown in use.
Figure 2:
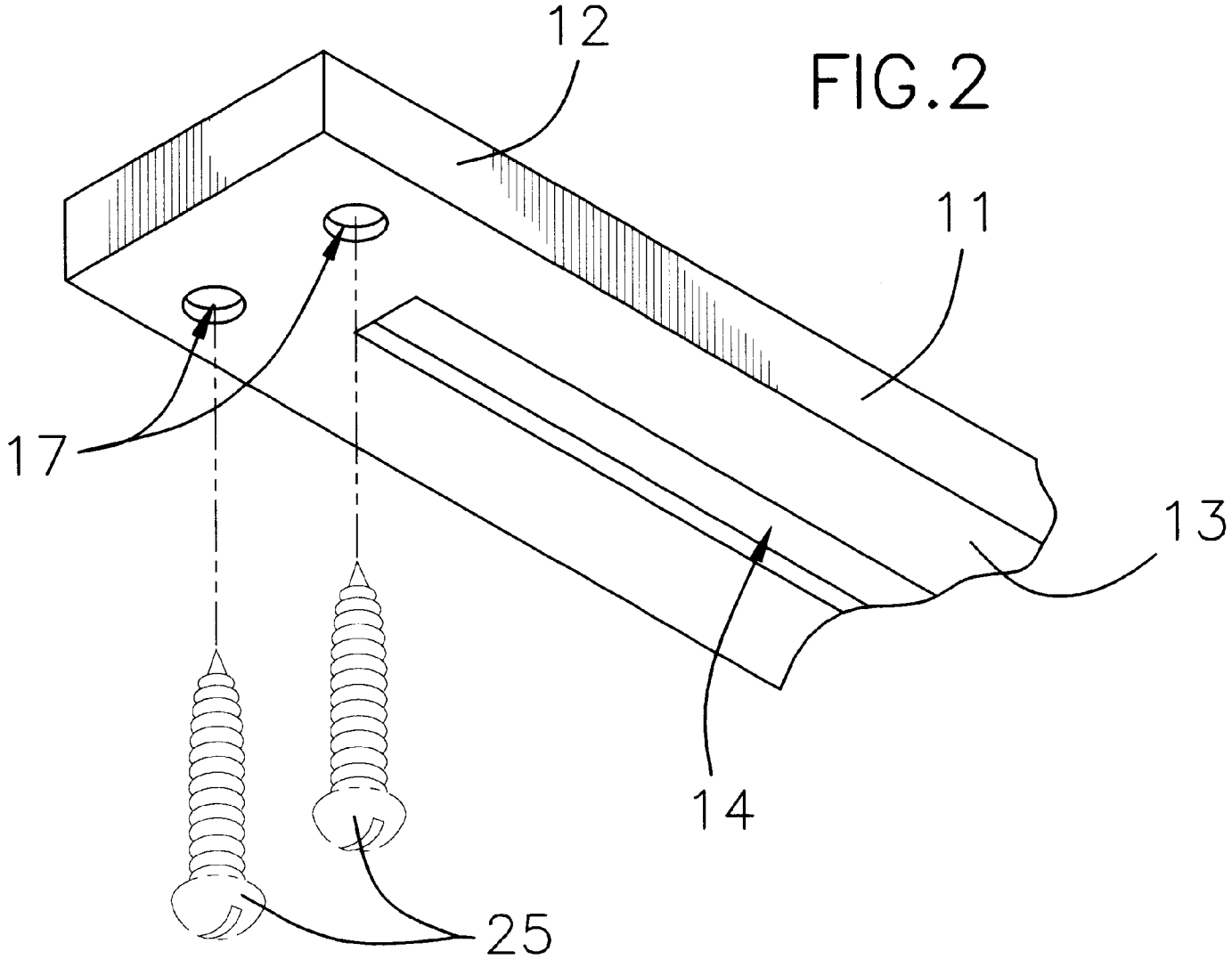
FIG. 2 is a partial perspective view of one of the elongate light support members of the present invention.
Figure 3:
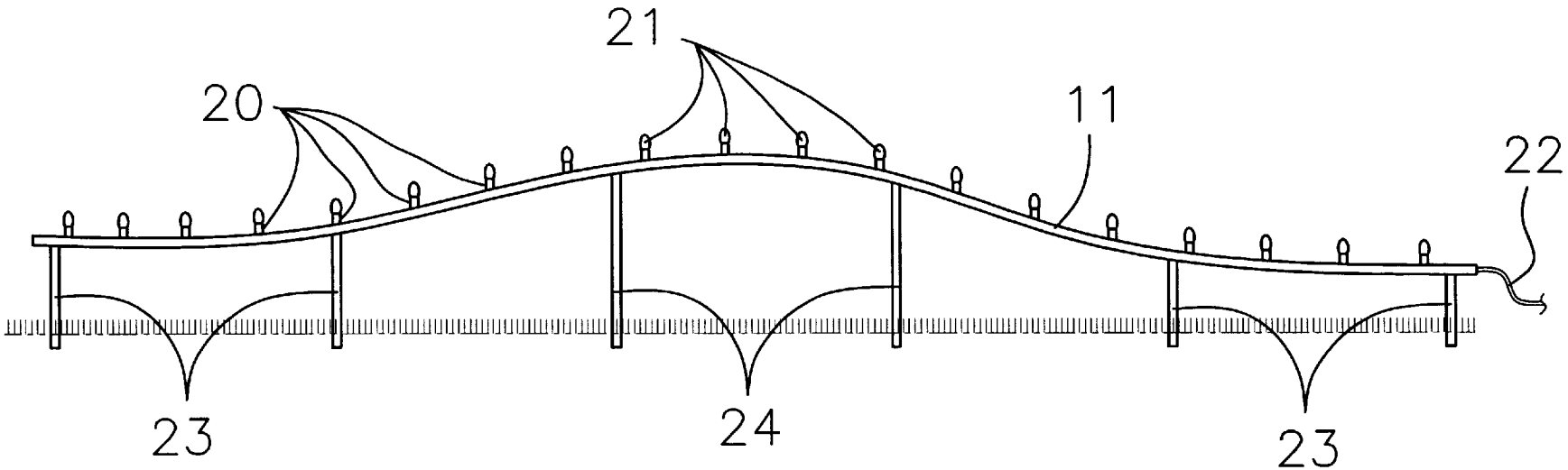
FIG. 3 is a side elevational view of the present invention.
Figure 4:
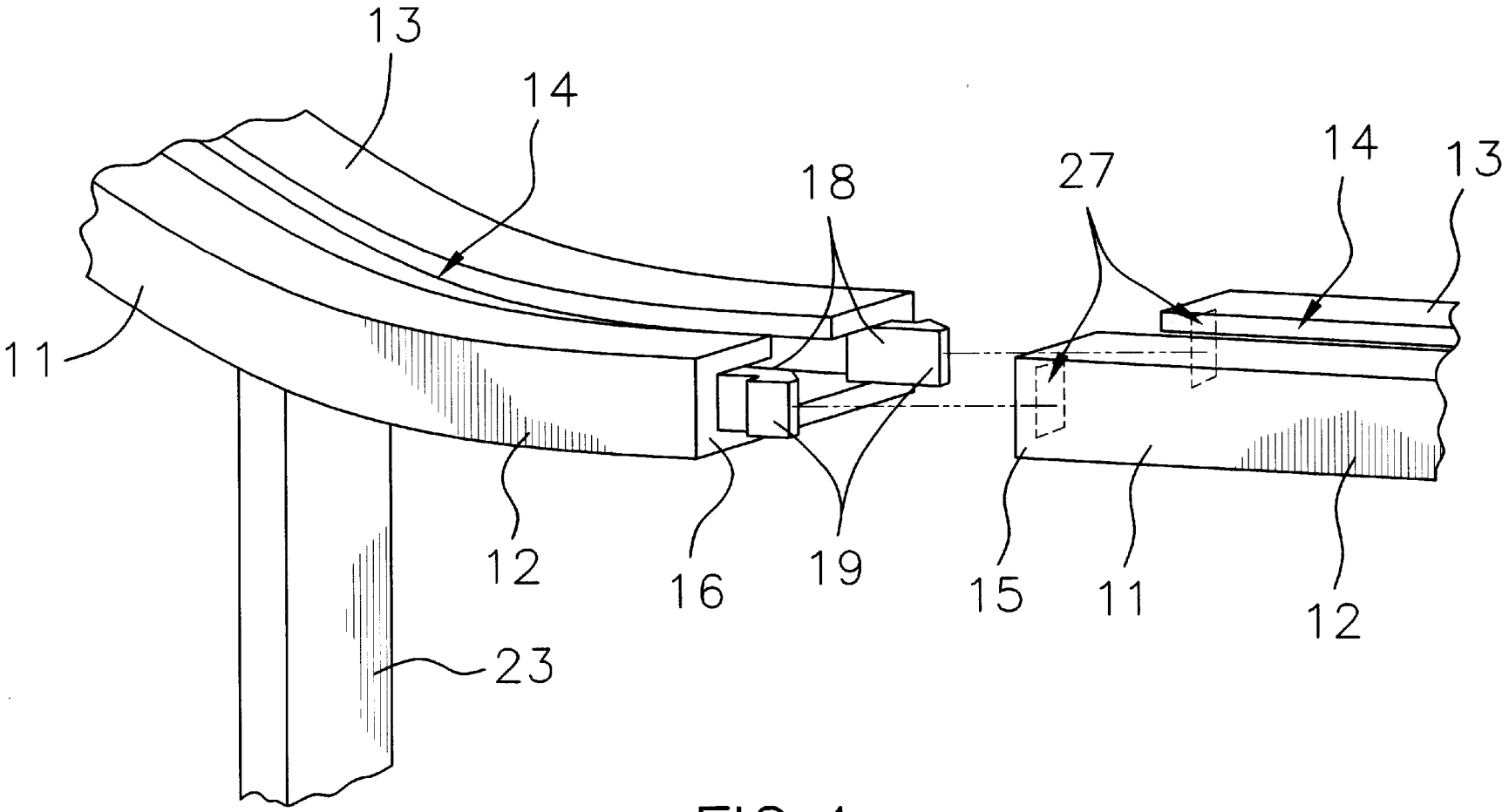
FIG. 4 is a partial exploded perspective view of two of the elongate light support members of the present invention.

With reference now to the drawings, and in particular to FIGS. 1 through 4 thereof, a new outdoor decorative lighting system embodying the principles and concepts of the present invention and generally designated by the reference numeral 10 will be described.

As best illustrated in FIGS. 1 through 4, the outdoor decorative lighting system 10 generally comprises a light support assembly including a plurality of elongate light support members 11 being fastenably connected end-to-end. A light-emitting assembly is conventionally mounted upon the elongate light support members 11 and includes a plurality of light socket members 20 being spaced apart and being interconnected with wires and being conventionally mounted upon the elongate light support members 11, and also includes a plurality of light-emitting members 21 being removably disposed in the light socket members 20, and further includes a power cord 22 being conventionally connected to one of the light socket members 20.

As a first embodiment, the light support assembly includes a plurality of post members 23,24 being adapted to be disposed upon a surface with the elongate light support members 11 being mounted upon the post members 23,24. The post members 23,24 include first post members 23 and second post members 24 which are relatively longer than the first post members 23.

As a second embodiment, each of the elongate light support members 11 is a strip of rigid material 12 having a thickness and a width and also having a groove 14 centrally disposed in a side 13 and extending a length thereof and further having a first end 15 and a second end 16. The elongate light support members 11 also have holes 17 being disposed through the sides 13 and near the first and second ends 15,16 thereof and being adapted to receive fasteners 25 for fastening the elongate light support members 11 to a structure 26. The light-emitting assembly further includes openings 27 being disposed in the first ends 15 of the strips of rigid material 12, and also includes clip members 18 having hook-like ends 19 and extending outwardly from the second ends 16 of the strips of rigid material 12 and being fastenably received in the openings 27 of adjacent strips of rigid material 12 for fastenably connecting the strips of rigid material 12 end-to-end.

In use, the user snaps the elongate support members 11 together and fastens the elongate support members either to the post members 23,24 or to a building structure 26 with the light socket members 20 being securely disposed in the grooves 14 of the longate support members 11 with the light-emitting members 21 being removably disposed in the light socket members 20 and with the power cord 22 being plugged in an electrical outlet to energize the light-emitting members.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An outdoor decorative lighting system comprising:

a light support assembly including a plurality of elongate light support members being fastenably connected end-to-end, each of said elongate light support members being curved along a length thereof such that a portion of said light assembly is positionable at a first distance from a surface while another portion of said light assembly is positionable at a second distance from the surface; and a light-emitting assembly being mounted upon said elongate light support members and including a plurality of light socket members being spaced apart and being interconnected with wires and being mounted upon said elongate light support members, and also including a plurality of light-emitting members being removably disposed in said light socket members, and further including a power cord being connected to one of said light socket members;

wherein said light support assembly includes a plurality of post members for mounting to the surface, said post members being mounted on and extending away from said elongate light support members, said post members including first post members and second post members, said second post members having a length relatively longer than a length of said first post members such that said second post members support said light assembly at a greater distance from the surface than said first post members support said light assembly from the surface.

2. An outdoor decorative lighting system as described in claim 1, wherein each of said elongate light support members is a strip of rigid material having a thickness and a width, and also having a groove centrally disposed in a side and extending a length thereof, and further having a first end and a second end, said elongate light support members also having holes disposed through said sides for receiving fasteners for fastening said elongate light support members to a structure.

3. An outdoor decorative lighting system as described in claim 2, wherein each of said first ends of said strips includes openings disposed therein, and also includes clip members having hook-like ends and extending outwardly from each of said second ends of said strips of rigid material and being fastenably received in said openings of adjacent said strip of rigid material for fastenably connecting said strips of rigid material end-to-end.

4. An outdoor decorative lighting system as described in claim 1, wherein a portion of said light support assembly has a substantially U-shaped configuration along the length of the light support assembly.

5. An outdoor decorative lighting system as described in claim 1, wherein a portion of said light support assembly has a configuration substantially corresponding to a portion of a sine waveform along the length of the light support assembly.

6. An outdoor decorative lighting system comprising:

a light support assembly including a plurality of elongate light support members being fastenably connected end-to-end, each of said elongate light support members being curved along a length thereof such that a portion of said light assembly is positionable at a first distance from a surface while another portion of said light assembly is positionable at a second distance from the surface; and a light-emitting assembly being mounted upon said elongate light support members and including a plurality of light socket members being spaced apart and being interconnected with wires and being mounted upon said elongate light support members, and also including a plurality of light-emitting members being removably disposed in said light socket members, and further including a power cord being connected to one of said light socket members;

wherein said light Support assembly includes a plurality of post members for mounting to the surface, said post members being mounted on and extending away from said elongate light support members, said post members including first post members and second post members, said second post members having a length relatively longer than a length of said first post members such that said second post members support said light assembly at a greater distance from the surface than said first post members support said light assembly from the surface;

wherein each of said elongate light support members is a strip of rigid material having a thickness and a width, and also having a groove centrally disposed in a side and extending a length thereof, and further having a first end and a second end said elongate light support members also having holes disposed through said sides for receiving fasteners for fastening said elongate light support members to a structure;

wherein each of said first ends of said strips includes openings disposed therein, and also includes clip members having hook-like ends and extending outwardly from each of said second ends of said strips of rigid material and being fastenably received in said openings of adjacent said strip of rigid material for fastenably connecting said strips of rigid material end-to-end; and wherein a portion of said light support assembly has a configuration substantially corresponding to a portion of a sine waveform along the length of the light support assembly.

7. An outdoor decorative lighting system comprising:

a light support assembly including a plurality of elongate light support members being fastenably connected end-to-end, each of said elongate light support members being curved along a length thereof such that a portion of said light assembly is positionable at a first distance from a surface while another portion of said light assembly is positionable at a second distance from the surface; and a light-emitting assembly being mounted upon said elongate light support members and including a plurality of light socket members being spaced apart and being interconnected with wires and being mounted upon said elongate light support members, and also including a plurality of light-emitting members being removably disposed in said light socket members, and further including a power cord being connected to one of said light socket members;

wherein each of said elongate light support members is a strip of rigid material having a thickness and a width, and also having a groove centrally disposed in a side and extending a length thereof, and further having a first end and a second end, said elongate light support members also having holes disposed through said sides for receiving fasteners for fastening said elongate light support members to a structure; and wherein each of said first ends of said strips includes openings disposed therein, and also includes clip members having hook-like ends and extending outwardly from each of said second ends of said strips of rigid material and being fastenably received in said openings of adjacent said strip of rigid material for fastenably connecting said strips of rigid material end-to-end.

8. An outdoor decorative lighting system as described in claim 7, wherein a portion of said light support assembly has a substantially U-shaped configuration along the length of the light support assembly.

9. An outdoor decorative lighting system as described in claim 7, wherein a portion of said light support assembly has a configuration substantially corresponding to a portion of a sine waveform along the length of the light support assembly.

* * * * *